United States Patent [19]

Ryan, Jr.

[11] Patent Number: 4,603,781

[45] Date of Patent: Aug. 5, 1986

[54] SHELF ASSEMBLY

[75] Inventor: Delvin R. Ryan, Jr., Lake Forest, Ill.

[73] Assignee: SEVKO, Inc., Deerfield, Ill.

[21] Appl. No.: 539,262

[22] Filed: Oct. 5, 1983

[51] Int. Cl.[4] ..... A47F 5/08

[52] U.S. Cl. ..... 211/90; 211/153

[58] Field of Search ..... 211/90, 134, 153, 181; 248/235

[56] References Cited

U.S. PATENT DOCUMENTS

| | | | |
|---|---|---|---|
| 306,335 | 10/1884 | Higley | 211/90 |
| 913,228 | 2/1909 | McCarthy | 211/90 X |
| 1,599,653 | 9/1926 | Cranston | 248/235 X |
| 2,639,817 | 5/1953 | Ehret | 211/90 X |
| 2,747,745 | 5/1956 | Sontheim | 211/90 |
| 2,887,802 | 5/1959 | Burmeister | 211/90 X |
| 3,346,314 | 10/1967 | Actor | 211/90 X |
| 3,348,699 | 10/1967 | Mealing | 211/90 |
| 3,698,329 | 10/1972 | Diamond | 211/90 X |
| 4,426,057 | 1/1984 | Nudo | 211/90 X |

*Primary Examiner*—Ramon S. Britts
*Assistant Examiner*—Sarah A. Lechok Eley
*Attorney, Agent, or Firm*—Ronald A. Sandler; Jerry A. Schulman; Timothy T. Patula

[57] ABSTRACT

A shelf assembly comprising a plurality of parallel spaced platform members and a plurality of spaced frame members fixedly connected to the platform members so as to define a grid-like shelf, each of the frame members extending normal to the platform members and each having distal ends extending beyond the outer most platform members. A pair of allochirally configurated shelf end support brackets is provided, each end bracket having means for freely supporting the distal ends of the frame members so as to support the shelf in a generally horizontal plane when the support brackets are secured to an associated wall.

2 Claims, 10 Drawing Figures

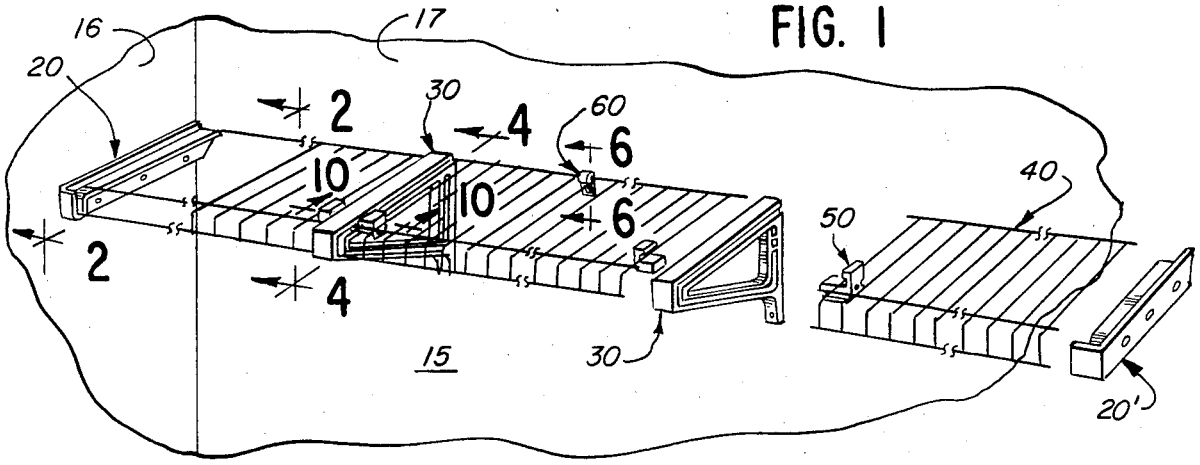
FIG. 1
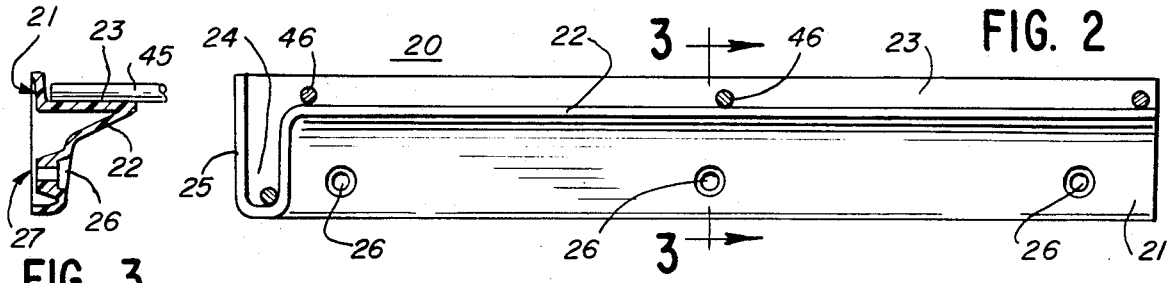
FIG. 2
FIG. 3
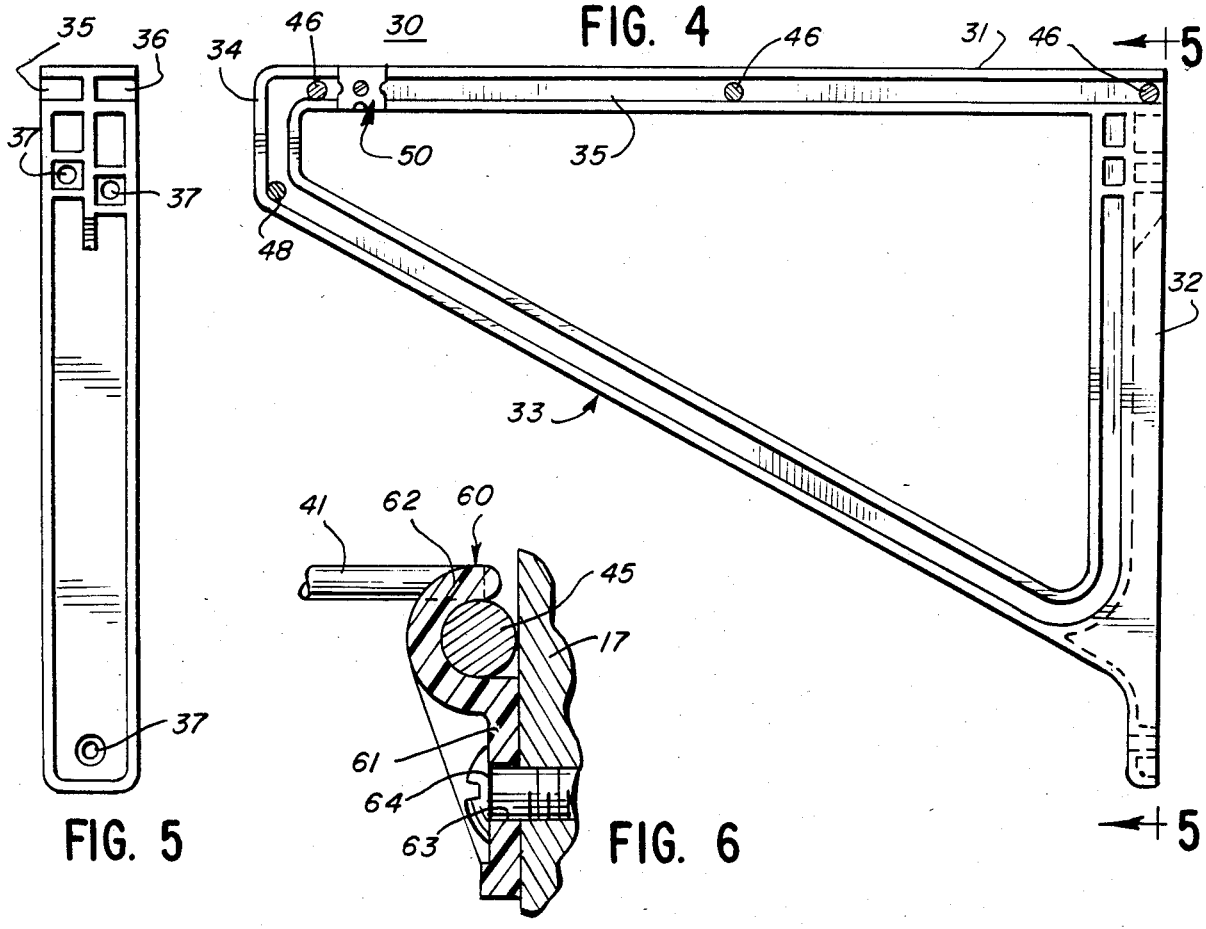
FIG. 4
FIG. 5
FIG. 6

FIG. 7
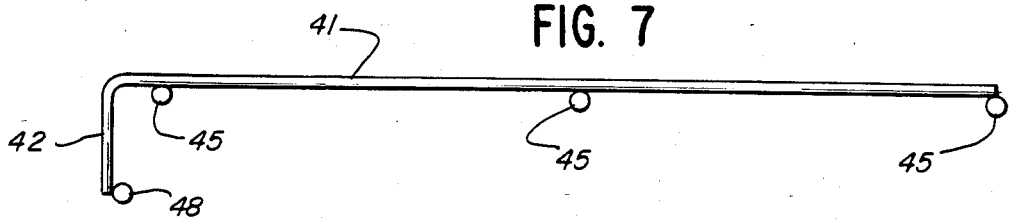
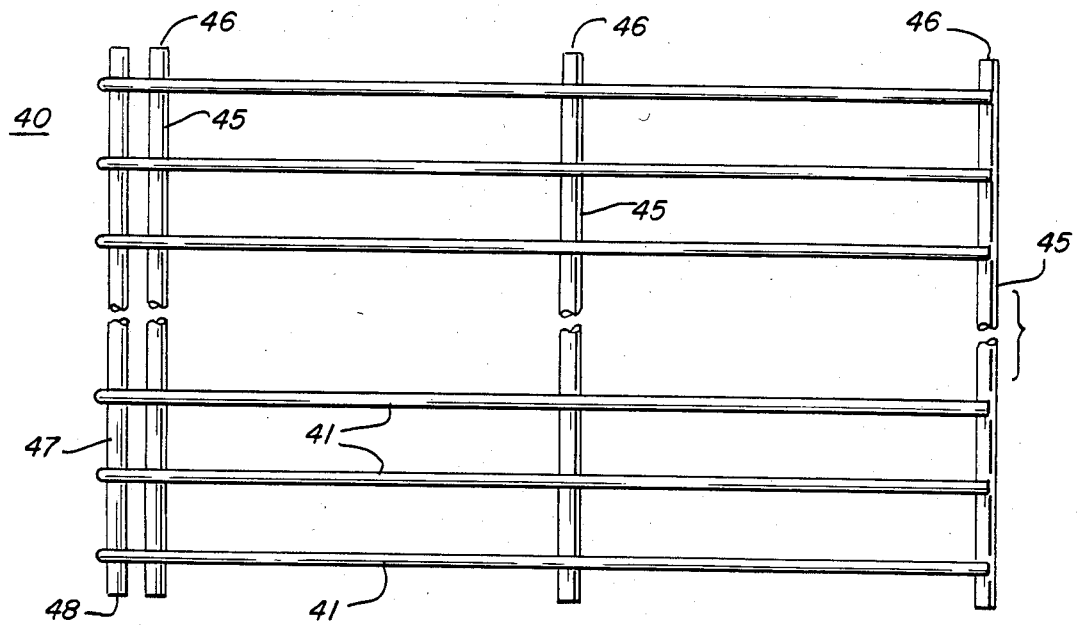
FIG. 8
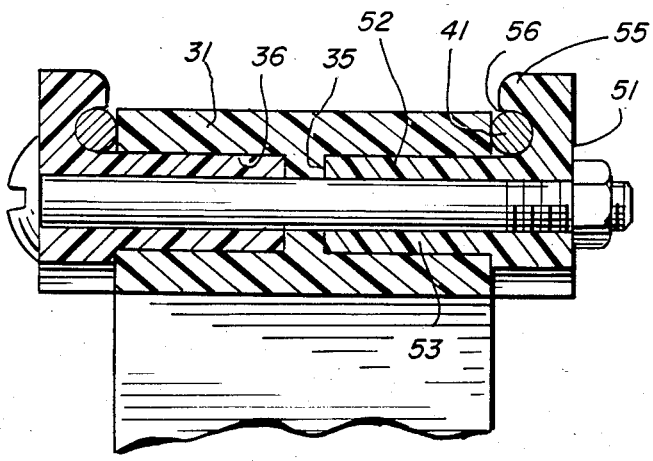
FIG. 10
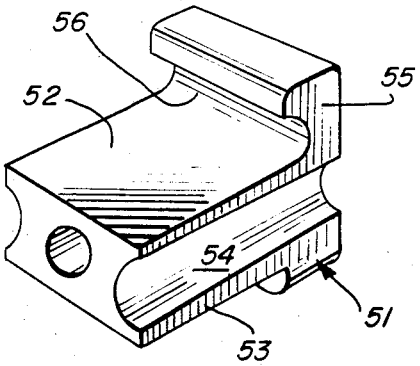
FIG. 9

SHELF ASSEMBLY

BACKGROUND OF THE INVENTION

The present invention relates to the field of storage shelf assemblies, and, more particularly, to a shelf assembly which is adaptable for easy and convenient installation in areas having different wall configurations.

Prior art shelf assemblies often have the problem that the shelf portion of the assembly is not at all secured to the shelf mounting brackets, thus permitting accidental movement. Unsecured shelves may be very undesirable if objects are to be placed on the shelf without evenly distributing their weight, causing the shelf to become unbalanced and tumble the objects placed thereon.

Although some shelf assemblies may overcome this problem by securing the shelf to the mounting brackets, excessive effort may then be required for disassembly to remove or replace a single shelf. Often a shelf needs replacement or repair because of damage or deterioration through misuse, or an accident, or from long-term outdoor exposure, or warping caused by climate variations. It may also be desirable to change the color or style of a shelf for aesthetic reasons.

Furthermore, many shelf assemblies must be custom fitted to the particular wall arrangement encountered. The additional time and expense of a custom fit can be minimized by a shelf assembly which is flexible in its application to various wall arrangements. The present invention discloses an inexpensive but durable shelf assembly which can be used with a variety of wall arrangements, and, with modest modification, can easily be adjusted in width, overcoming minor building dimension irregularities.

SUMMARY OF THE INVENTION

The present invention provides a shelf assembly for mounting on one or more walls. The shelf is comprised of a plurality of periodically spaced and parallel platform members and a plurality of spaced parallel frame members fixedly connected to the platform members to provide a grid-like structure. The frame members each have distal ends extending beyond the outermost platform members. The assembly also includes at least two mirror image or allochirally configurated shelf end support brackets. Each of the end brackets has means for detachably receiving and supporting the opposite distal ends of the frame members so as to support the shelf in a predisposed plane, generally horizontally. Each of the end brackets includes provisions for fastening it to an associated wall.

Each of the end support brackets comprises an elongated base member having a first generally planar surface for juxtaposition with the associated vertical wall, and a flange integrally formed therewith and extending generally outwardly therefrom. The flange is provided with a platform surface adapted to receive the distal ends of the frame members of the shelf in a plane parallel to the plane of the platform surface on the flanges of the opposing end members.

The shelf assembly also may include more than one shelf member successively positioned adjacent to another. In this instance at least two rectangular shelves are provided, and a central support bracket is disposed between the shelf end support brackets. The central support bracket includes means for receiving and supporting the adjacent distal ends of the frame members of each associated shelf, whereby the end brackets and the central bracket cooperate to support the shelves in a common plane. Simple fastener means for detachably securing the contiguous platform members of the adjacent shelves to the central support bracket also is provided as part of the assembly.

The present invention generally provides a shelf assembly which may use two types of mounting brackets to mount one or more similar type shelves on a vertical wall or walls. The different type of mounting brackets allow flexibility in using the shelf assembly with various wall arrangements. The shelf (or shelves) is simply secured to the support brackets so as to provide a stable surface on which to put objects without worry of uneven weight distribution. The shelf is easily secured to the brackets and is detachable from the support brackets without requiring disassembly of those brackets from the associated walls.

It therefore is a primary object of the present invention to produce a shelf assembly which will provide the user with easy assembly and disassembly of the shelf from the support brackets if desired.

It is another object of the invention to produce a shelf assembly that will exhibit the benefits of a shelf surface that is secured to the mounting brackets without the inconvenience of difficult shelf replacement or removal, upon desire of the user.

It is a further object of this invention to provide a shelf assembly that is maintenance free, either in indoor or outdoor environments and without special preventative precautions such as painting or the like.

The invention, both as to its organization and method of operation, together with other objects and advantages thereof, will best be understood with reference to the following specification, taken in combination with the accompanying drawings.

BRIEF DESCRIPTION OF THE DRAWINGS

In the drawings in which similar elements are given similar reference characters:

FIG. 1 is a partially exploded and fragmentary perspective view of the shelf assembly of the present invention;

FIG. 2 is an elevational view of one end bracket of the present invention, taken in the direction of the arrows 2—2 in FIG. 1;

FIG. 3 is a sectional view of the end bracket taken along the lines 3—3 in FIG. 2;

FIG. 4 is an elevational view of the central support bracket forming part of the shelf assembly of the present invention, taken in the direction of the arrows 4—4 of FIG. 1;

FIG. 5 is a rear view of the central support bracket, taken in the direction of the arrows 5—5 in FIG. 4;

FIG. 6 is a cross sectional side view of one fastener used for connecting a shelf of the invention to an associated wall, taken along lines 6—6 in FIG. 1;

FIG. 7 is an end view of a shelf forming part of the present invention;

FIG. 8 is a fragmentary top plan view of a shelf of the present invention;

FIG. 9 is a perspective view of the fastening means for detachably securing a shelf to a central support bracket; and FIG. 10 is a partial sectional view of a central support bracket of the present invention, taken along lines 10—10 in FIG. 1, and illustrating two shelves releasably held to that bracket.

DESCRIPTION OF THE PREFERRED EMBODIMENTS

Turning now to FIG. 1, the shelf assembly of the present invention is generally designated as 15. The illustrated shelf assembly 15 includes a plurality of generally identical shelves 40, successively positioned adjacent to one another. The outer ends of the shelves 40 are supported by mirror image or allochirally configurated end support brackets 20 and $20^1$, and, in the illustrated embodiment, a pair of central support brackets designated generally as 30.

With reference to FIG. 8, Each shelf 40 is comprised of a plurality of parallel spaced platform members or rods 41 and a plurality of parallel spaced frame members 45, fixedly connected to the platform members so as to define the grid-like shelf 40. Each of the frame members 45 extends normal to the platform members 41, and each of the frame members has distal ends 46 extending beyond the outer most platform members 41. In its simplest form, each shelf 40 is supported by a pair of allochirally configurated shelf end support brackets 20, $20^1$, each said bracket 20, $20^1$ having means for freely supporting the distal ends 46 of the frame members 45 so as to support a shelf 40 in a generally horizontal plane when the support brackets 20, $20^1$ are secured to associated walls.

Each platform member 41 includes a right angled leg 42; a guide member 47 similar to the frame members 45 and parallel thereto is fixedly secured to the lower portion of each leg 42, whereby the guide member 47 is in a different plane from the frame members 45. The guide member 47 also has distal ends 48 extending beyond the platform members 41.

Each of the end support brackets 20, $20^1$ is identical except that they are the mirror image of one another, and therefore only the bracket 20 will be described in detail. The end bracket 20 comprises an elongated base member 21, having a first generally planar surface 27 for juxtaposition to an associated vertical wall, and a flange 22 integrally formed therewith and extending generally outwardly therefrom, the flange being provided with a platform surface 23 adapted to receive the distal ends of the frame members 45 of the shelf 40 in a plane parallel to the plane of the platform surface 23 on the flange 22. The flange 22 on the end bracket 20 is provided with a slot 24 therein adapted to receive a distal end 48 of the guide member 47 of shelf 40, thereby to prevent relative motion between the shelf 40 and the end brackets 20, $20^1$ when the shelf is disposed thereon. The slot 24 is disposed at the forward end of the bracket 20 and includes a portion 25 of the flange 22 extending above the platform surface 23 of the flange, thereby to conceal the distal end 48 of the guide members 47 and the distal ends 46 of the frame members 45 and providing a finished appearance to the assembly.

As illustrated in FIGS. 2 and 3, the end support bracket 20 may be fastened to the associated side wall 16 by a conventional fastener (not shown) which passes through a plurality of apertures generally designated as 26.

It will be apparent that a single shelf 40 easily can be supported on a pair of the end brackets 20, $20^1$, simply by setting the shelf thereon so that the distal ends 46 of rods 41 of the frame are supported by the parallel platform surfaces 23, $23^1$ on the flanges 22, $22^1$, with the distal ends 48 of the guide member 47 positioned within the slots 24, $24^1$.

Where more than one shelf is needed or desired, or to mount the shelves in cantilevered fashion on a single wall, the assembly 15 uses one or more of the central support brackets 30. A central support bracket 30 as illustrated in greater detail in FIGS. 4, 5 and 10. The bracket 30 is generally triangularly shaped, having a shelf support leg 31, adapted to receive and hold the adjoining distal ends 46 of the associated pair of shelves 40; a wall leg 32 adapted to be fixedly secured to to an associated wall 17; and a brace leg 33 interconnecting the support leg 31 and the wall leg 32.

The legs are provided with inwardly extending U-shaped channels 35, 36 on opposite sides thereof which are adapted to receive and to support the distal ends 46, 48 of the frame members and the guide members of the associated adjacent shelves. As illustrated, the channels 35 and 36 also provide a uniform decorative finish.

As shown, the wall leg 32 includes a plurality of bores 37 which can be used with any conventional means, such as screws or the like, to fasten the wall leg 37 (and thus central support bracket 30), to an associated rear wall 17, as shown in FIG. 1. Appropriate ribbing 37A can be provided at fastening points for added rigidity and to prevent compression of hte member during fastening.

Depending upon the usage of the shelf 40, the present invention contemplates spacing the platform rods 41 to accommodate the particular objects or the weight that the shelf will be subjected to. The present invention also contemplates the use of other types of members than rods to form the shelf 40. Neither is the invention limited to a shelf having grid-like or L-shaped structure. A solid shelf may be used, provided it has outwardly extending distal ends to engage the flanges 22 on the end members 20 or the channels 35, 36 in a central support member 30. When a guide member distal end 48 has been inserted into an appropriate slot 24 or channel 35, 36, the movement of the shelf 40 is restricted.

As part of the design of the assembly, simple fastening means 50 is provided to assure easy securement of the shelf platform members to the central support bracket 30. In the illustrated embodiment, this fastening means 50 comprises a main body portion 51 having a pair of laterally extending somewhat resilient arms 52 and 53. The resiliency is provided by aperture 54 in the arms. The base 51 further has an upwardly extending lip 55 thereon in which is provided a groove 56 having a radius substantially corresponding to the circumferential shape of the associated platform support members 41. Upon compression of the arms 52 and 53 and insertion completely into one of the channels, the groove 56 will engage the contiguous platform member 41 disposed adjacent thereto and will hold that member in juxtaposition with the adjacent wall defining one of the channels. When the arms 52 and 53 are released, then, because of their resiliency, they will exapnd outwardly slightly and thereby provide a relatively tight fit within the channel. To assure there is no accidental movement, an appropriate fastener such as bolt 57 can be passed through aperture 54 and secured by a complementary nut 58 to hold the distal ends 46 in position within the engaged channels.

Finally, the shelf assembly 15 includes retaining means 60 for securing at least one of the shelf frame members 45 directly to an associated wall thereby to prevent movement of the shelf, if so desired. In this instance, the retaining means 60 comprises a base member 61, a C-shaped portion 62 adapted to overlie an adjacent frame member 45. An aperture 63 is formed in the base 61 in order to receive an appropriate fastener such as 64 therein, whereby to secure the retaining means directly to the associated wall 17.

As will be seen, among the advantages of the shelf assembly of the present invention is the inherent flexibility in the design by use of the different types of brackets 20 or 30 as well as by using shelves which can be designed in different preset lengths such as, for example, 24" or 36". Also, by forming the flanges 22 so they extend laterally a distance greater than the distance between the centers of adjacent platform support members 41, it will be apparent that, if desired, the length of the shelf member 40 can be varied by the purchaser by cutting through the frame members 45 and guide member 47. Thus, for example, if one wished to make the shelf considerably smaller, he could cut through those members and simply leave distal end portions extending outwardly so as to be sure that there is some portion which will rest on the platform surface 23 of an associated flange 22.

In an exemplary embodiment, the platform surface 23 on flange 22 may be approximately $1\frac{1}{2}$" wide while the spacing of the platform rods 41 would be approximately 1" on center. The rods would preferably be of steel wire with the frame rods being approximately $\frac{1}{4}$" in diameter and the platform rods approximately $\frac{1}{8}$" in diameter. The distal ends 46 and 47 of the respective rods would extend approximately $\frac{1}{2}$" beyond the last platform member 41 secured thereto. The front leg portion 42 is about $1\frac{3}{4}$" inches long.

The shelf brackets 20 and 30 are preferably formed of a high impact polystyrene while the clips 50 and 60 described herein preferably are formed of polypropylene. Other plastics, such as thermoset and thermoplastics may be used, provided they have the requisite physical characteristics necessary to meet the contemplated use for the shelf assembly. The shelves may be made of wire rod which is dipped to provide a plastic protective coating. The shelf brackets and clips may be color coordinated to provide a bright, attractive system.

As the figures illustrate, a shelf assembly is provided that allows easy assembly and disassembly of a shelf from the mounting brackets if desired by the user. The mounting brackets need not be disassembled in order to remove the shelf for either repair or replacement.

The two types of mounting brackets used by the invention allow use of the assembly with areas which have various wall arrangements. Two or more central brackets 30 could be used with a shelf or shelves 40 supported on a single wall. A pair of end brackets 20, 20[1] could be used with a shelf between two closely spaced walls. In an orthogonal configuration of three walls, several shelves could be used supported by a combination of end and central brackets. This allows the user great flexibility.

It is also important to note that the shelves are secured to the mounting brackets so that the shelves may support an uneven weight distribution without fear of having a shelf become unstable, while the shelf may be easily removed without disassembling the mounting brackets.

While there have been shown, described and pointed out the fundamental novel features of the invention as applied to the preferred embodiments, it will be understood that various omissions and substitutions and change of the form and details of the devices illustrated and in their operation may be made by those skilled in the art, without departing from the spirit and scope of the invention.

What is claimed is:

1. A shelf assembly attachable to an associated wall or walls, said assembly comprising:

a plurality of parallel spaced platform members and a plurality of spaced frame members fixedly connected to said platform members so as to define a generally rectangular grid-like shelf member, each of said frame members extending normal to said platform members, each said frame member having distal ends extending beyond the outermost platform members;

a pair of shelf end support brackets, each said bracket having means for freely supporting the distal ends of said frame members so as to support said shelf in a generally horizontal plane when said support brackets are secured to said wall or walls;

each of said end support brackets including an elongated base member having a first generally planar surface for juxtaposition with said wall, and a flange integrally formed therewith and extending generally outwardly therefrom, said flange being provided with a platform surface adapted to receive and support one said of said distal ends of said frame members of said shelf in a plane parallel to the plane of said platform surface on said flange and;

said shelf member further including a guide member parallel to said frame members and disposed in a different plane, said guide member also having distal ends extending beyond said platform members, each said flange of said end support bracket being provided with a slot therein adapted to receive the adjacent distal end of one said guide member thereby to prevent relative motion between said shelf member and said end bracket when said shelf member is disposed thereon, each said slot being disposed at the forward portion of one end bracket, said slot including a front wall extending above the platform surface of said flange, to conceal the distal ends of said guide member and said frame members, providing a finished appearance to said assembly.

2. A shelf assembly attachable to an associated wall or walls, said assembly comprising:

a plurality of parallel spaced contiguous platform members and a plurality of spaced frame members fixedly connected to said platform members so as to define a generally rectangular grid-like shelf member, each said frame member extending normal to said platform members, each said frame member having distal ends extending beyond the outermost of said platform members;

a pair of shelf end support brackets, each said end bracket having means for freely supporting the distal ends of said frame members so as to support said shelf in a generally horizontal plane when said end brackets are secured to said wall or walls;

a central support bracket positionable between said end brackets;

said central support bracket including means for receiving and supporting the distal ends of the frame members of a pair of said shelf assemblies, each said shelf assembly having an endmost platform member adjacent to said central support bracket whereby said end brackets and said central support bracket cooperate to support said shelf assemblies in a common plane;

said central support bracket including a generally triangular member having a shelf support leg adapted to receive and hold the distal ends of said pair of shelf assemblies generally parallel to said end bracket, a wall leg adapted to be fixedly secured to and thereby to secure said central support bracket to one said associated wall, and a brace leg inter-connecting said support leg and said wall leg;

said support leg having inwardly extending channels on opposite sides thereof, adapted to receive and support the distal ends of said frame members of said pair of shelf assemblies positioned on opposite sides of said central support bracket;

means for detachably fastening said pair of shelf assemblies to said central support bracket;

said fastening means including a body portion having a pair of laterally extending resilient arms which are adapted to be engaged in said channel provided in said shelf support leg, said body portion having a lip extending therefrom providing a groove therein to receive a portion of one said endmost platform member and to hold said member in juxtaposition with said channel of said shelf support leg when said arms are inserted in said channel; and means for attaching said body portion to said channel.

* * * * *